US007290988B2

(12) United States Patent
Boston et al.

(10) Patent No.: US 7,290,988 B2
(45) Date of Patent: Nov. 6, 2007

(54) DEVICE FOR BLOCKING A RING FOR AXIALLY RETAINING A BLADE, ASSOCIATED ROTOR DISK AND RETAINING RING, AND ROTOR AND AIRCRAFT ENGINE COMPRISING THEM

(75) Inventors: Erick Jacques Boston, Cesson (FR); Alain Marc Lucien Bromann, Vulaines/Seine (FR); Pierre Debeneix, St Sauveur sur Ecole (FR); Frederic Paul Eichstadt, Livry/Seine (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/466,987

(22) Filed: Aug. 24, 2006

(65) Prior Publication Data

US 2007/0048141 A1 Mar. 1, 2007

(30) Foreign Application Priority Data

Aug. 31, 2005 (FR) ..... 05 52635

(51) Int. Cl.
*F01D 5/30* (2006.01)

(52) U.S. Cl. ..... 416/220 R

(58) Field of Classification Search ..... 416/220 R
See application file for complete search history.

(56) References Cited

U.S. PATENT DOCUMENTS 4,033,705 A * 7/1977 Luebering ..... 416/220 R
4,221,542 A 9/1980 Acres et al.
4,730,983 A * 3/1988 Naudet et al. ..... 416/220 R
5,320,492 A 6/1994 Bouru et al.
6,234,756 B1 5/2001 Ress, Jr. et al.

FOREIGN PATENT DOCUMENTS

EP 1 443 179 A2 8/2004
FR 2 729 709 7/1996

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A device for rotationally blocking a retaining ring (20) on a rotor disk (10) includes successive first (162, 262) and second (164, 264) blocking hooks of the disk (10), at least one cleat (302, 304, 306) of the retaining ring (20) arranged close to a split (24) in the ring (20). The position of the at least one cleat (302, 304, 306) on the retaining ring (20) is such that, when the retaining ring (20) is in place in a groove (22) situated in the rotor disk (10), the at least one cleat (302, 304, 306) is in abutment against the first blocking hook (162, 262), and the split (24) is covered by the second blocking hook (164, 264).

19 Claims, 2 Drawing Sheets

DEVICE FOR BLOCKING A RING FOR AXIALLY RETAINING A BLADE, ASSOCIATED ROTOR DISK AND RETAINING RING, AND ROTOR AND AIRCRAFT ENGINE COMPRISING THEM

BACKGROUND OF THE INVENTION

The present invention relates to the technical field of rings for axially retaining the blades of a rotor of a turbomachine, in particular of an aircraft engine.

It is aimed at a device for rotationally blocking such a retaining ring.

It is also aimed at a rotor retaining ring equipped with such a rotation-blocking device.

It is additionally aimed at a rotor comprising a retaining ring equipped with such a rotation-blocking device.

It is finally aimed at a turbomachine, for example an aircraft engine, comprising such a retaining ring equipped with such a rotation-blocking device.

Throughout the text, the term "axial" refers to the axial direction of the turbomachine.

DESCRIPTION OF THE PRIOR ART

It is known that a turbomachine rotor is equipped with a disk and with blades carried by the disk, and also with a retaining ring for preventing a displacement of the blades in the axial direction, as described in document FR 2 729 709-A1.

FIG. 1 illustrates such a ring for retaining the blades of a rotor, known from the prior art.

Referring to FIG. 1, a disk 10 of a rotor comprises a disk body 11 and teeth 12 which extend radially from the disk body 11 and are spread around the circumference thereof. The space between two successive teeth 12 forms an axially oriented recess 13. Each tooth 12 is provided with at least one hook 6 which projects in an axial direction and which in this tooth defines an individual groove opening radially inward. In the example illustrated, the teeth 12 are provided with an upstream hook 6 and with a downstream hook 6.

FIG. 2 illustrates a root 14 of a blade 16 inserted into one such recess 13. The two teeth 12 make it possible to contain this blade 16 both circumferentially and radially.

As illustrated in FIG. 2, and in a known manner, a retaining ring 20 is placed in a discontinuous groove 22 which corresponds to the succession of the individual grooves. The presence of the retaining ring 20 in the groove 22 makes it possible to prevent an axial displacement of the blades 16. To facilitate its installation in the groove 22, the retaining ring 20 is open by way of a split 24 which separates the two ends or strands 26 of this ring.

It is generally preferred for the split 24 in the retaining ring 20 to be situated at the level of one of the teeth 12 and not between two adjacent teeth 12 so as to prevent the ends of the retaining ring 20 from coming out of the groove 22. For this purpose, it is known practice to provide the retaining ring 20 with a rotation-blocking device which ensures that the split 24 remains positioned at the level of the one tooth 12, once the retaining ring 20 has been installed in the groove 22.

The device for rotationally blocking the retaining ring 20 according to the prior art, illustrated in FIG. 1, comprises:

two cleats 30 of the retaining ring 20, which are respectively arranged at the two ends 26 of this ring, on each side of the split 24, and which each have a contact face 32 directed toward the split 24, and a stop-forming hook 60 of one of the teeth 12, this stop-forming hook 60 having a front face 42 and two lateral faces 44 which are substantially opposed to one another, the lateral faces 44 being obtained by machining the lateral sides of the stop-forming hook 60.

When the retaining ring 20 is put in place in the groove 22, each contact face 32 of the respective cleats 30 is in abutment against one of the lateral faces 44 of the stop-forming hook 60. Consequently, the split 24 is situated beneath the stop-forming hook 60 and the retaining ring 20 is prevented from turning, with the result that the retaining ring 20 cannot spontaneously come out of the groove 22 during the operation of the turbomachine. It follows that the blades 16 cannot escape from the recesses 13 in which their roots 14 are inserted.

SUMMARY OF THE INVENTION

The present invention provides a device for rotationally blocking a ring for retaining the blades of a rotor of a turbomachine, which constitutes an alternative to the rotation-blocking device of the prior art which has been described above.

According to a first aspect, the invention relates to a device for rotationally blocking a ring for retaining blades on a rotor disk of a turbomachine in a substantially axial direction of said turbomachine, said rotor disk being provided with hooks spread around its circumference and defining a groove for accommodating said retaining ring, and said retaining ring being provided with a split.

The blocking device comprises:

- successive first and second blocking hooks of said rotor disk, and
- at least one cleat of said retaining ring, arranged on a ring face close to said split.

The position of said at least one cleat on said retaining ring is such that, when said retaining ring is in place in said groove, said at least one cleat is in abutment against said first blocking hook, and the split is covered by said second blocking hook.

As will become apparent from the remainder of the description, the term "blocking hook" covers two functions performed by one or other or both of these two hooks: a stop function for a cleat and a function of covering the split.

Preferably, said first blocking hook is provided with a check face on its side which faces the second blocking hook, said cleat of the retaining ring is provided with a contact face oriented toward its side which is opposite to the side facing said split, and said check face cooperates with said contact face in order to bring said cleat into abutment against said first blocking hook.

According to a first embodiment, the blocking device comprises:

- successive first and second blocking hooks of said rotor disk, and
- first and second cleats of the retaining ring, which are arranged on a ring face on the same side of said split, said first cleat being closer to said split than said second cleat.

According to this first embodiment, the positions of said first and second cleats on the retaining ring are such that, when said retaining ring is in place in said groove, said first and second cleats are in abutment against said first blocking hook, on each side thereof, and said split is covered by said second blocking hook.

Preferably, said first blocking hook is provided with one check face on its side which faces said second blocking hook and with another check face on its opposite side, said cleats of said retaining ring are each provided with a contact face, the contact face of said second cleat being on its side which faces said split, and the contact face of said first cleat being on its side which is opposite to its side facing said split, and said check faces cooperate with said contact faces in order to bring said cleats into abutment against said first blocking hook.

According to a second embodiment, the blocking device comprises:

successive first and second blocking hooks of said rotor disk, and a single cleat of said retaining ring, arranged on a ring face close to said split. According to this second embodiment, the position of said cleat on said retaining ring is such that, when said retaining ring is in place in said groove, said first cleat is in abutment against said first blocking hook and against said second blocking hook, and said split is covered by said second blocking hook.

Preferably, said first blocking hook is provided with a check face on its side which faces said second blocking hook, said second blocking hook is provided with a check face on its side which faces said first blocking hook, said cleat of said retaining ring is provided with two contact faces, one of said contact faces being on its side which faces said split, and the other of said contact faces being on its opposite side, and said check faces cooperate with said contact faces in order to bring said first and second blocking hooks into abutment against said cleat.

In a manner which is common to the two embodiments of the blocking device, the groove has two walls, one internal wall which is closer to the rotor disk and one external wall which is further from the rotor disk, wherein each check face is situated on said corresponding blocking hook and extends in the axial direction, starting from the free surface of said blocking hook and continuing as far as the internal wall of said groove.

According to one variant, each check face is oriented in a radial plane of said rotor disk.

According to another variant, each check face is oriented in an oblique plane with respect to a radial plane of said rotor disk.

According to a second aspect, the invention relates to a rotor disk of a turbomachine, this disk being provided with hooks spread around its circumference. The rotor disk comprises a first blocking hook and a second blocking hook in succession. In a manner which is common to the first and second embodiments, said first blocking hook is provided with a check face on its side which faces said second blocking hook.

According to the first embodiment of the rotor disk, said first blocking hook is additionally provided with another check face on its side opposite to its side which faces said second blocking hook.

According to the second embodiment of the rotor disk, said second blocking hook is provided with a check face on its side which faces said first blocking hook.

In a known manner, said hooks define a groove for accommodating a retaining ring, and said groove has two walls, one internal wall which is closer to the rotor disk and one external wall which is further from the rotor disk.

According to the invention, each check face is situated on the corresponding blocking hook and extends in the axial direction, starting from the free surface of said blocking hook and continuing as far as the internal wall of said groove.

According to one variant embodiment, said check faces are oriented in a radial plane of said rotor disk.

According to another variant embodiment, said check faces are oriented in an oblique plane with respect to a radial plane of said rotor disk.

According to a third aspect, the invention relates to a ring for retaining the blades of a turbomachine rotor, intended to be combined with a rotor disk according to the first aspect of the invention, comprising a split and at least one cleat which is arranged on a ring face.

According to a first embodiment, said retaining ring comprises two cleats which are arranged on a ring face on the same side of said split.

According to a second embodiment, said retaining ring comprises a single cleat arranged on a ring face on one side of said split.

According to a fourth aspect, the invention relates to a disk/ring assembly, comprising a retaining ring provided with a split, and comprising a rotor disk provided with hooks spread around its circumference and defining a groove for accommodating said retaining ring, wherein said rotor disk comprises a first blocking hook and a second blocking hook in succession, wherein said retaining ring comprises at least one cleat arranged on a ring face close to said split, and wherein the position of said cleat on said retaining ring is such that, when said retaining ring is in place in said groove, said cleat is in abutment against said first blocking hook, and the split is covered by said second blocking hook.

Preferably, said first blocking hook is provided with a check face on its side which faces the second blocking hook, said at least one cleat of the retaining ring is provided with a contact face on its side which is opposite to its side facing said split, and said check face cooperates with said contact face in order to bring said cleat into abutment against said first blocking hook.

According to a first embodiment of the disk/ring assembly said retaining ring comprises first and second cleats arranged on a ring face on the same side of said split, said first cleat being closer to said split than said second cleat. According to this first embodiment, the positions of said first and second cleats on the retaining ring are such that, when said retaining ring is in place in said groove, said first and second cleats are in abutment against said first blocking hook, on each side thereof, and said split is covered by said second blocking hook.

According to this first embodiment of the disk/ring assembly, said first blocking hook is provided with one check face on its side which faces said second blocking hook and with another check face on its opposite side, said cleats of said retaining ring are each provided with a contact face, the contact face of said second cleat being on its side which faces said split, and the contact face of said first cleat being on its side which is opposite to its side facing said split, and said check faces cooperate with said contact faces in order to bring said cleats into abutment against said first blocking hook.

According to a second embodiment of the disk/ring assembly, said retaining ring comprises a single cleat arranged on a ring face close to said split. According to this second embodiment, the position of said cleat on said retaining ring is such that, when said retaining ring is in place in said groove, said single cleat is in abutment against said first blocking hook and against said second blocking hook, and said split is covered by said second blocking hook.

According to this second embodiment of the disk/ring assembly, said first blocking hook is provided with a check face on its side which faces said second blocking hook, said second blocking hook is provided with a check face on its side which faces said first blocking hook, said cleat of said retaining ring is provided with two contact faces, one of said contact faces being on its side which faces said split, and the other of said contact faces being on its opposite side, and said check faces cooperate with said contact faces in order to bring said first and second blocking hooks into abutment against said cleat.

According to a fifth aspect, the invention relates to a turbomachine rotor comprising a blocking device according to the first aspect of the invention and/or a rotor disk according to the second aspect of the invention and/or a retaining ring according to the third aspect of the invention and/or a disk/ring assembly according to the fourth aspect of the invention.

According to a sixth aspect, the invention relates to a turbomachine, for example an aircraft engine, comprising a blocking device according to the first aspect of the invention and/or a rotor disk according to the second aspect of the invention and/or a retaining ring according to the third aspect of the invention and/or a disk/ring assembly according to the fourth aspect of the invention.

BRIEF DESCRIPTION OF THE DRAWINGS

The invention will be better understood on reading the detailed description below of embodiments of the invention, which are given by way of illustration and impose no limitation, with reference to the appended drawings, in which.

DESCRIPTION OF THE PREFERRED EMBODIMENTS

Figure 1:
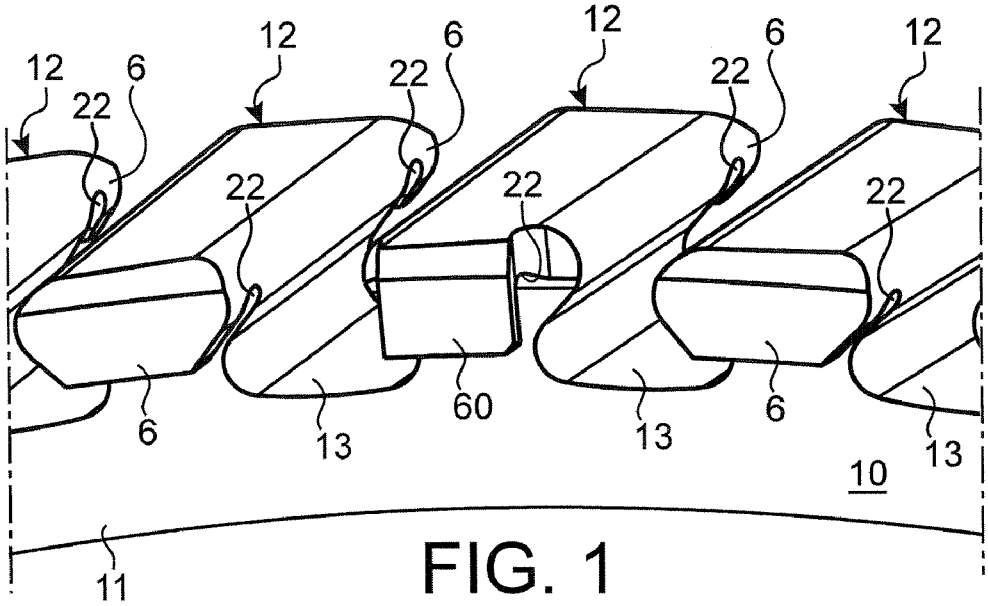
FIG. 1, already described, shows a perspective view of a portion of a rotor disk adapted for a device for rotationally blocking a ring for retaining blades.
Figure 2:
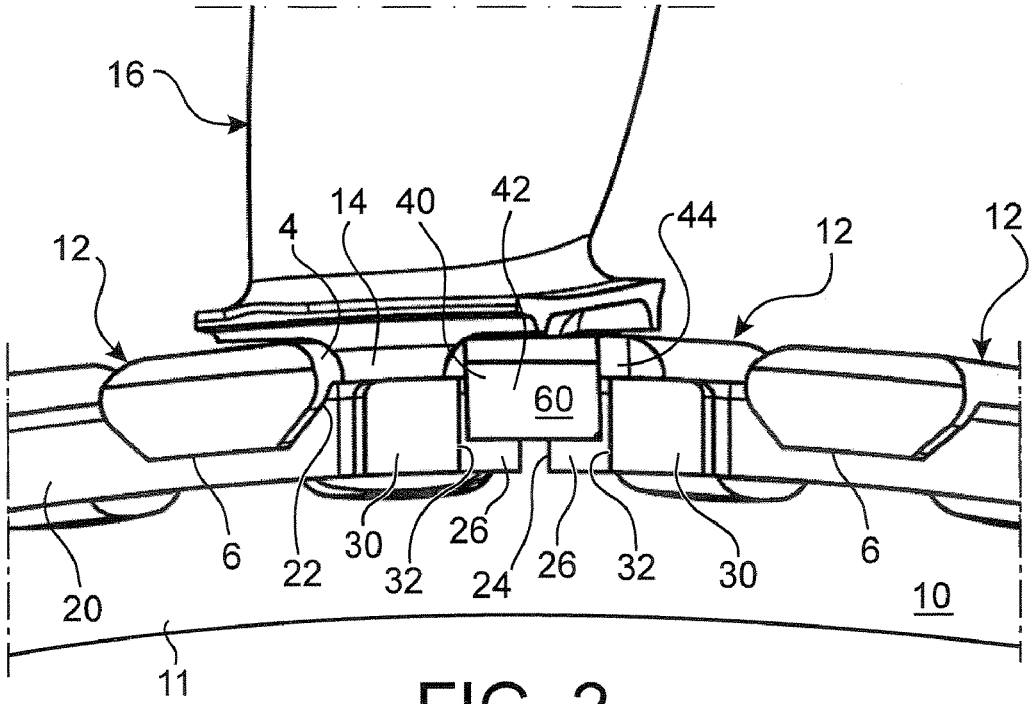
FIG. 2, already described, shows a perspective view of a device for rotationally blocking a ring for retaining blades of a turbomachine rotor, according to the prior art.

The two embodiments of the rotation-blocking device according to the invention, illustrated in FIGS. 3 and 4, will be described only in terms of their differences over the rotation-blocking device according to the prior art, illustrated in FIG. 2. In the figures, identical references denote identical features.

To simplify the detailed description which follows, the retaining ring will be simply referred to as "ring" and the first and second blocking hooks will be simply referred to as "first hook" and "second hook" respectively.

Figure 3:
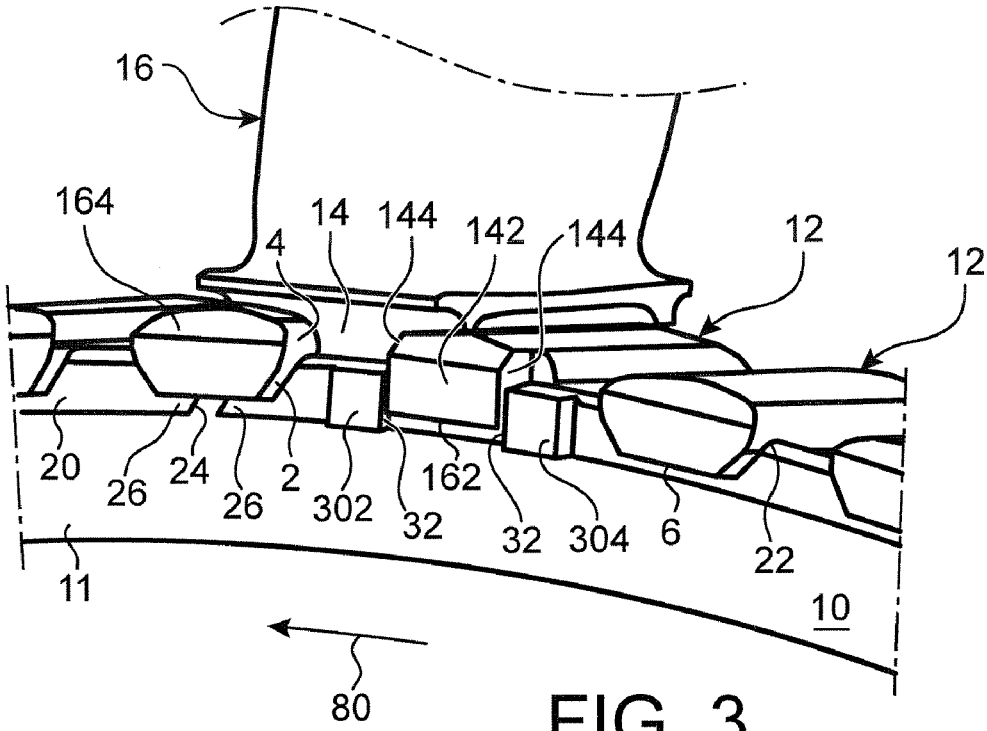
FIG. 3 shows a perspective view of a device for rotationally blocking a ring for retaining blades of a turbomachine rotor, according to a first embodiment of a device for blocking a retaining ring according to the invention.
Figure 4:
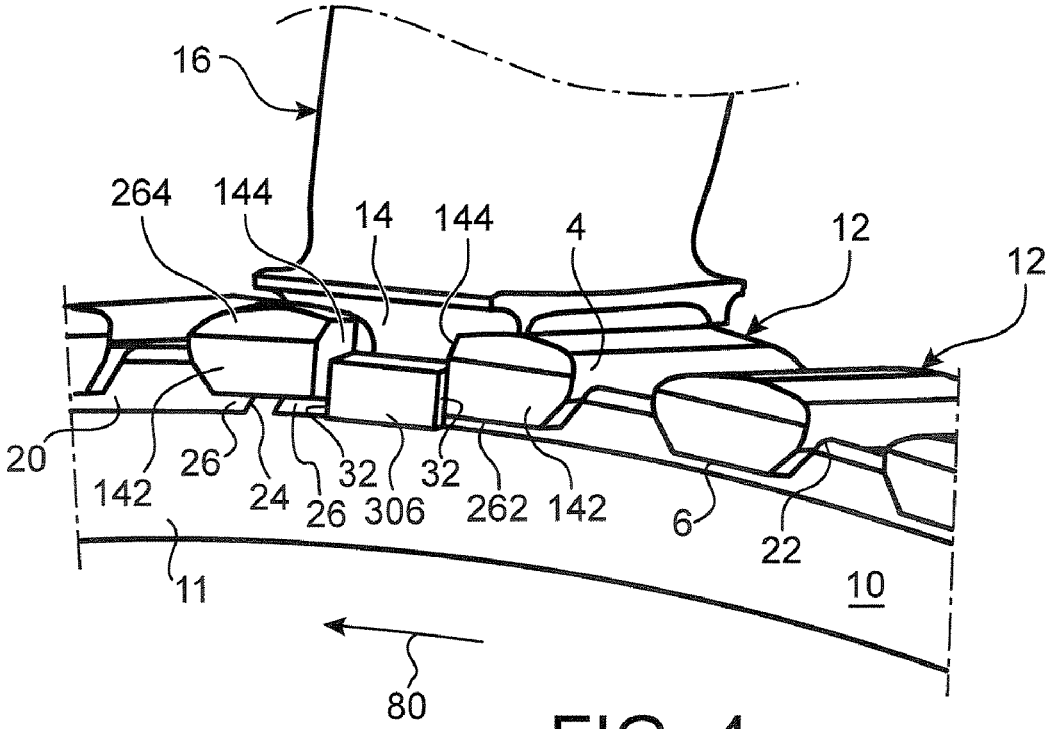
FIG. 4 is analogous to FIG. 3, for a second embodiment of a device for blocking a retaining ring according to the invention.

Referring to FIGS. 3 and 4, a disk 10 of a rotor comprises teeth 12 which extend radially from its circumference and are spread around this circumference.

The space between two successive teeth 12, 222, 224 forms an axially oriented recess 13 in which is inserted a root 14 of a detachable blade 16. These two successive teeth 12 have shapes and dimensions which make it possible to contain, both circumferentially and radially, the blade 16 installed between them in the recess 13.

The teeth 12 have a projecting portion 4 which protrudes from the disk 10 in the axial direction toward the upstream side and/or a projecting portion 4 which protrudes from the disk 10 in the axial direction toward the downstream side. Within each projecting portion 4 is formed an individual groove which opens radially inward, the free end of each projecting portion 4 beyond the individual groove with respect to the disk body 11 forming a hook 6 oriented radially inward. Each individual groove has two walls, one internal wall which is closer to the rotor disk 10 and one external wall which is further from the rotor disk 10.

The succession of the individual grooves forms a discontinuous groove 22 in which the ring 20 is arranged. The ring 20 in the groove 22 constitutes an axial stop which makes it possible to prevent an axial displacement of the blades 16. To facilitate its installation in the groove 22, this ring 20 is open by way of a split 24 which separates its two ends 26 from one another.

A description will now be given of the blocking device of the rotor disk 10 and of the ring 20 according to the first embodiment of the invention, with reference to FIG. 3.

Among the hooks 6 there are, in succession, a first hook 162 and a second hook 164. The second hook 164 has a geometry which is similar to the geometry of the hooks 6 of the prior art.

The first hook 162 has a geometry which is modified in relation to that of the hooks 6. It has a front face 142, which is the face of its free surface, and two lateral surfaces 144 which are substantially perpendicular to the front surface 142. Each of these two lateral faces 144 extends from the front face 142 of the first hook 162 as far as the internal wall of the individual groove of this first hook 162. Preferably, the two lateral faces 144 are obtained by a machining operation on each lateral side of the first hook 162, that is to say on the side which faces the second hook 164 and on the opposite side to the side facing the second hook 164. In other words, the corresponding tooth 12 is terminated by a hook 162 which has two lateral faces 144, these lateral faces being set back circumferentially.

In the example illustrated in FIG. 3, the lateral faces 144 are oriented in a radial plane of the rotor disk 10.

The ring 20 comprises a split 24 and two cleats 302, 304 positioned on the opposite face to the face of the ring which faces the rotor disk 10.

Preferably, each cleat 302, 304 is produced in the following way. Two cuts are made in the ring 20 so as to allow removal of a ring sector having a given dimension in the circumferential direction of said ring 20 and the same dimension as the remainder of the ring 20 in the axial direction. The removed sector is replaced by a piece having the same dimension in the axial direction and the same dimension in the circumferential direction, but having a greater thickness. This piece is fastened to the remainder of the ring 20 by welding so as to reconstitute a closed ring 20. The cleat 302, 304 is then machined into said piece having a greater thickness than the remainder of the ring 20. Such a procedure makes it possible to carry out precise machining of the cleats 302, 304, ensuring their dimensions and their position on the ring 20.

The split 24 is made in the ring 20 following the production of the cleats 302, 304. It is positioned such that the two cleats 302, 304 are arranged on the same side of the split 24, toward one of the ends 26 of the ring 20. The first cleat 302 is closer to the split 24 than the second cleat 304.

Each cleat 302, 304 comprises a contact face 32. The contact face 32 of the second cleat 304 is oriented toward the split 24. The contact face 32 of the first cleat 302 is oriented toward the opposite side.

Given a suitable position of the two cleats 302, 304 on the ring 20, when the ring 20 is put in place in the groove 22, the contact face 32 of each cleat 302, 304 is in abutment against one of the lateral faces 144 of the first hook 162. The lateral faces 144 are check faces of the first hook 162 which cooperate with the respective contact faces 32 of the two cleats 302, 304 of the ring 20. The two ends 26 of the ring 20 and the split 24 are then situated beneath the second hook 164.

The position of the two cleats 302, 304 on the ring 20 is established in a suitable manner, preferably depending on the dimensions and distances of the first and second hooks 162, 164 of the rotor disk 10. The position of the first cleat 302 is defined so that the split 24 is situated beneath the second hook 164 while the contact face 32 of the first cleat 302 is situated against the check face 144 of the first hook 162. The position of the second cleat 304 is defined by the distance between the two cleats 302, 304, which is substantially equal to the distance separating the two check faces 144 of the first hook 162.

With such a blocking device, the ring 20 is prevented from turning in the groove 22. Consequently, it cannot escape from the groove 22 during the operation of the turbomachine. It follows that the blades 16 cannot escape in the direction of the recess 13 in which they are inserted.

Advantageously, in this embodiment, the two cleats 302, 304 are situated in the vicinity of the split 24, which makes it possible to reduce any risk of escape from the groove 22 by the end 26 of the ring 20 that is situated on the same side as the two cleats 302, 304.

Advantageously, in this embodiment, the two cleats 302, 304 are situated upstream of the split 24 in the direction of rotation of the rotor, which is denoted by the reference 80 in FIG. 3. With this direction of rotation 80, the check face 144 of the first hook 162 that faces the second hook 164 is the one which mainly provides a checking action, in cooperation with the first cleat 302 of the ring 20.

A description will now be given of the blocking device of the rotor disk 10 and of the ring 20 according to the second embodiment of the invention, with reference to FIG. 4.

Among the hooks 6 there are, in succession, a first hook 262 and a second hook 264.

The two hooks 262, 264 have a geometry which is modified in relation to that of the hooks 6. Each hook 262, 264 has a front face 142 which is the face of its free surface, and a lateral face 144 which is substantially perpendicular to the front face 142 and which faces the other hook 264, 262. The lateral face 144 of the first hook 262, or of the second hook 264, respectively, extends from the front face 142 of said hook 262, 264 as far as the internal wall of the individual groove of said hook 262, 264. Preferably, the lateral face 144 of the first hook 262 is obtained by a machining operation on its lateral side which faces the second hook 264. Analogously, the lateral face 144 of the second hook 264 is obtained by a machining operation on its lateral side which faces the first hook 262. In other words, each of the corresponding teeth 12 is terminated by a hook 262, 264 which has a lateral face 144 on its side facing the other hook 264, 262, said lateral face being set back circumferentially.

In the example illustrated in FIG. 4, the lateral faces 144 are oriented in a radial plane of the rotor disk 10.

The ring 20 comprises a split 24 and a single cleat 306 positioned on the opposite face to the face of the ring which faces the rotor disk 10. The cleat 306 is preferably produced by a method analogous to that which was described for the production of the cleats 302, 304 of the first embodiment of the blocking device.

The split 24 is made in the ring 20 following the production of the cleat 306. It is positioned such that the cleat 306 is arranged on one side of the split 24 and in the vicinity thereof, toward one of the ends 26 of the ring 20.

The cleat 306 comprises two contact faces 32. One of the contact faces 32 of the cleat 306 is oriented toward the split 24 and the other contact face 32 is oriented toward the opposite side.

Given a suitable position of the cleat 306 on the ring 20 and a suitable dimension of this cleat 306, when the ring 20 is put in place in the groove 22, each contact face 32 of the cleat 306 is in abutment against the lateral face 144 of the first hook 262 and against the lateral face 144 of the second hook 264. The lateral faces 144 of the first hook 162 and of the second hook 164 are check faces which cooperate with the respective contact faces 32 of the cleat 306 of the ring 20. The two ends 26 of the ring 20 and the split 24 are then situated beneath the second hook 264.

The position of the cleat 306 on the ring 20 and the width or circumferential dimension of the cleat 306 are established in a suitable manner, preferably depending on the dimensions and distances of the hooks 262, 264 of the rotor disk 10. The distance between the cleat 306 and the split 24 is defined so that the split 24 is situated beneath the second hook 264 while one of the contact faces 32 of the cleat 306 is situated against one of the two respective check faces 144 of the two hooks 262, 264. The width of the cleat 306 is substantially equal to the distance which separates the check face 144 of the first hook 262 and the check face 144 of the second hook 264.

With such a blocking device, the ring 20 is prevented from turning in the groove 22. Consequently, it cannot escape from the groove 22 during the operation of the turbomachine. It follows that the blades 16 cannot escape in the axial direction of the recess 13 in which they are inserted.

Advantageously, in this embodiment, the cleat 306 is situated in the vicinity of the split 24, which makes it possible to reduce any risk of escape from the groove 22 by the end 26 of the ring 20 that is situated on the same side as the cleat 306.

Advantageously, in this embodiment, the cleat 306 is situated upstream of the split 24 in the direction of rotation of the rotor, which is denoted by the reference 80 in FIG. 4. With this direction of rotation 80, the check face 144 of the first hook 262 is the one which mainly provides a checking action, in cooperation with the cleat 306 of the ring 20.

The invention which has just been described therefore makes it possible to prevent the ring 20 from turning in the groove 22. It has the advantage that the split 24 in the ring 20 is positioned beneath a hook and not between two hooks.

With the device for rotationally blocking the ring 20 according to the invention, the actual blocking function (by bringing contact faces 32 of the cleats into abutment against the check faces 144 of the hooks 162, 262, 264) and the function of covering the split 24 are not provided by a single disk hook, as was the case with the blocking device of the prior art.

An advantage of the device for blocking the ring 20 according to the invention, whether according to the first embodiment or according to the second embodiment, lies in the fact that it is possible to disassociate the width of the split 24, that is to say the clearance between the two ends or strands 26 of the ring 20, from the clearance required for mounting the ring 20 between the cooperating faces, namely at least one of the contact faces 32 and at least one of the check faces 144.

In the first embodiment, the first cleat 302 alone would make it possible to perform the function of rotationally blocking the ring 20, given the direction of rotation represented by the arrow 80. The second cleat 304 makes it possible, moreover, to maintain the opening of the split 24 between the two strands 26 and prevent these two strands 26 from coming into contact.

In the second embodiment, the function of rotationally blocking the ring 20 is performed by bringing one of the contact faces 32 of the cleat 306 into abutment with the check face 144 of the first blocking hook 262, given the direction of rotation represented by the arrow 80. Bringing the other of the contact faces 32 of the cleat 306 into abutment with the check face 144 of the second blocking hook 264 makes it possible, moreover, to control the position of the strand 26 bearing the cleat 306 with respect to the other strand 26, and to maintain the opening of the split 24 between the two strands 26, and to prevent them coming into contact. The cleat 306 is brought into abutment against the first hook 262 and against the second hook 264 by controlling the circumferential dimension of said cleat 306.

In the two embodiments, the effect achieved by controlling the circumferential clearance, that is to say the opening of the split 24, between the two strands 26 of the ring 20 is to improve the retention of these two strands 26 in the groove 22, and therefore the retention of the ring 20 in the groove 22.

The invention is not limited to the embodiments which have just been described. In the example illustrated in FIGS. 3 and 4, the split 24 is perpendicular to the circumferential direction of the ring 20, but it could be oblique without departing from the scope of the invention.

In the example illustrated in FIGS. 3 and 4, the check faces are oriented in a radial plane of the rotor disk, but they could be oriented in an oblique plane with respect to a radial plane of the rotor disk, without departing from the scope of the invention.

In the example illustrated in FIGS. 3 and 4, the recesses 13 in which are inserted the roots 14 of the blades 16 are oriented axially, but the invention equally applies to configurations in which the direction of the recesses forms an angle with the axial direction of the turbomachine.

The invention claimed is:

1. A device for rotationally blocking a ring for retaining blades on a rotor disk of a turbomachine in a substantially axial direction of said turbomachine, said rotor disk being provided with hooks spread around its circumference and defining a groove for accommodating said retaining ring, including successive first and second blocking hooks, and said retaining ring being provided with a split and with at least one cleat and which is arranged on a ring face close to said split, wherein the position of said at least one cleat on said retaining ring is such that, when said retaining ring is in place in said groove, said at least one cleat is in abutment against said first blocking hook, and the split is covered by said second blocking hook.

2. The rotation-blocking device as claimed in claim 1, wherein:

said first blocking hook is provided with a check face on its side which faces the second blocking hook, said cleat of the retaining ring is provided with a contact face on its side which is opposite to its side facing said split, and said check face cooperates with said contact face in order to bring said cleat into abutment against said first blocking hook.

3. The rotation-blocking device as claimed in claim 1 or 2, which comprises:

successive first and second blocking hooks of said rotor disk, first and second cleats of the retaining ring, which are arranged on a ring face on the same side of said split, said first cleat being closer to said split than said second cleat, and wherein the positions of said first and second cleats on the retaining ring are such that, when said retaining ring is in place in said groove, said first and second cleats are in abutment against said first blocking hook, on each side thereof, and said split is covered by said second blocking hook.

4. The rotation-blocking device as claimed in claim 3, wherein:

said first blocking hook is provided with one check face on its side which faces said second blocking hook and with another check face on its opposite side, said cleats of said retaining ring are each provided with a contact face, the contact face of said second cleat being on its side which faces said split, and the contact face of said first cleat being on its side which is opposite to its side facing said split, and wherein said check faces cooperate with said contact faces in order to bring said cleats into abutment against said first blocking hook.

5. The rotation-blocking device as claimed in claim 1 or 2, which comprises:

successive first and second blocking hooks of said rotor disk, a single cleat of said retaining ring, arranged on a ring face close to said split, and wherein the position of said cleat on said retaining ring is such that, when said retaining ring is in place in said groove, said cleat is in abutment against said first blocking hook and against said second blocking hook, and said split is covered by said second blocking hook.

6. The rotation-blocking device as claimed in claim 5, wherein:

said first blocking hook is provided with a check face on its side which faces said second blocking hook, said second blocking hook is provided with a check face on its side which faces said first blocking hook, said cleat of said retaining ring is provided with two contact faces, one of said contact faces being on its side which faces said split, and the other of said contact faces being on its opposite side, and wherein said check faces cooperate with said contact faces in order to bring said first and second blocking hooks into abutment against said cleat.

7. The blocking device as claimed in claim 2, in which the groove has two walls, one internal wall which is closer to the rotor disk and one external wall which is further from the rotor disk, wherein each check face is situated on said corresponding blocking hook and extends in the axial direction, starting from the free surface of said blocking hook and continuing as far as the internal wall of said groove.

8. The blocking device as claimed in claim 2, wherein each check face is oriented in a radial plane of said rotor disk.

9. The blocking device as claimed in claim 2, wherein each check face is oriented in an oblique plane with respect to a radial plane of said rotor disk.

10. A turbomachine rotor, which comprises a blocking device as claimed in claim 1.

11. An aircraft engine, which comprises a blocking device as claimed in claim 1.

12. A ring for retaining the blades of a turbomachine rotor, intended to be combined with a rotor disk provided with hooks spread around its circumference, including a first blocking hook and a second blocking hook in succession, said first blocking hook being provided with one check face on its side which faces said second blocking hook and with another check face on its side opposite to its side which faces said second blocking hook, said ring comprising a split and two cleats which are arranged on a face of this ring, wherein said two cleats are disposed on the same side of said split such that they can be respectively in abutment against one of said two check faces of said first blocking hook.

13. A ring for retaining the blades of a turbomachine rotor, intended to be combined with a rotor disk provided with hooks spread around its circumference, including a first blocking hook and a second blocking hook in succession, said first blocking hook being provided with a check face on its side which faces said second blocking hook, and said second blocking hook being provided with a check face on its side which faces said first blocking hook, said ring comprising a split, wherein said ring further comprises a single cleat, arranged on a ring face on one side of said split in the vicinity thereof, such that said single cleat can be in abutment against the check face of said first blocking hook and the check face of said second blocking hook.

14. A disk/ring assembly of a turbomachine, comprising a retaining ring provided with a split, and comprising a rotor disk provided with hooks spread around its circumference and defining a groove for accommodating said retaining ring, wherein said rotor disk comprises a first blocking hook and a second blocking hook in succession, wherein said retaining ring comprises at least one cleat arranged on a ring face close to said split, and wherein the position of said cleat on said retaining ring is such that, when said retaining ring is in place in said groove, said cleat is in abutment against said first blocking hook, and the split is covered by said second blocking hook.

15. The disk/ring assembly as claimed in claim 14, wherein said first blocking hook is provided with a check face on its side which faces the second blocking hook, said at least one cleat of the retaining ring is provided with a contact face on its side which is opposite to its side facing said split, and said check face cooperates with said contact face in order to bring said cleat into abutment against said first blocking hook.

16. The disk/ring assembly as claimed in claim 14, wherein said rotor disk comprises a first blocking hook and a second blocking hook in succession, wherein said retaining ring comprises first and second cleats arranged on a ring face on the same side of said split, said first cleat being closer to said split than said second cleat, and wherein the positions of said first and second cleats on the retaining ring are such that, when said retaining ring is in place in said groove, said first and second cleats are in abutment against said first blocking hook, on each side thereof, and said split is covered by said second blocking hook.

17. The disk/ring assembly as claimed in claim 16, wherein said first blocking hook is provided with one check face on its side which faces said second blocking hook and with another check face on its opposite side, said cleats of said retaining ring are each provided with a contact face, the contact face of said second cleat being on its side which faces said split, and the contact face of said first cleat being on its side which is opposite to its side facing said split, and wherein said check faces cooperate with said contact faces in order to bring said cleats into abutment against said first blocking hook.

18. The disk/ring assembly as claimed in claim 14, wherein said rotor disk comprises a first blocking hook and a second blocking hook in succession, wherein said retaining ring comprises a single cleat arranged on a ring face close to said split, and wherein the position of said cleat on said retaining ring is such that, when said retaining ring is in place in said groove, said single cleat is in abutment against said first blocking hook and against said second blocking hook, and said split is covered by said second blocking hook.

19. The disk/ring assembly as claimed in claim 18, wherein said first blocking hook is provided with a check face on its side which faces said second blocking hook, said second blocking hook is provided with a check face on its side which faces said first blocking hook, said cleat of said retaining ring is provided with two contact faces, one of said contact faces being on its side which faces said split, and the other of said contact faces being on its opposite side, and wherein said check faces cooperate with said contact faces in order to bring said first and second blocking hooks into abutment against said cleat.

* * * * *